US009433311B2

(12) United States Patent
Gast

(10) Patent No.: US 9,433,311 B2
(45) Date of Patent: Sep. 6, 2016

(54) TWIST-FOLD CONTAINERS

(71) Applicant: Mandarin Associates Ltd., Kowloon (HK)

(72) Inventor: Barro de Gast, Purmerend (NL)

(73) Assignee: MANDARIN ASSOCIATES LTD., Kowloon (HK)

( * ) Notice: Subject to any disclaimer, the term of this patent is extended or adjusted under 35 U.S.C. 154(b) by 0 days.

(21) Appl. No.: 14/157,034

(22) Filed: Jan. 16, 2014

(65) Prior Publication Data

US 2014/0197178 A1 Jul. 17, 2014

Related U.S. Application Data

(60) Provisional application No. 61/753,329, filed on Jan. 16, 2013.

(51) Int. Cl.
*A47G 19/30* (2006.01)

(52) U.S. Cl.
CPC ..... *A47G 19/30* (2013.01)

(58) Field of Classification Search
CPC ..... A47G 19/30; A47G 19/00; A47G 21/00; A47F 5/02; A47J 43/0727
USPC ..... 220/9.1–9.3, 4.34, 8, 574; 206/600; 211/85, 90.03, 126.3, 126.7, 126.8, 211/126.9, 126.11, 126.12, 128.1, 129.1, 211/130.1, 131.1, 131.2, 132.1
See application file for complete search history.

(56) References Cited

U.S. PATENT DOCUMENTS

| | | | | | |
|---|---|---|---|---|---|
| 1,238,074 | A * | 8/1917 | Labadie | G09F 5/02 | 190/17 |
| 2,287,312 | A * | 6/1942 | Kader | 206/541 | |
| 2,721,663 | A * | 10/1955 | James | 211/126.11 | |
| 5,413,825 | A * | 5/1995 | Chaikin | F21S 4/001 | 211/196 |
| 6,758,348 | B2 * | 7/2004 | Adkins | A47L 19/02 | 211/100 |
| 2004/0155038 | A1 * | 8/2004 | Smith | 220/9.2 | |
| 2011/0038664 | A1 * | 2/2011 | Pearson et al. | 403/220 | |
| 2012/0219685 | A1 * | 8/2012 | Radow | A47G 19/00 | 426/420 |

* cited by examiner

*Primary Examiner* — Anthony Stashick
*Assistant Examiner* — James M Van Buskirk
(74) *Attorney, Agent, or Firm* — Lowe Graham Jones, PLLC

(57) ABSTRACT

Twist-fold containers include wires that are pivotally connected to channels formed in the containers. Using a twisting motion, the containers including the wires are collapsed. The collapsing, twisting motion is produced though the use of wires that are displaced in a plurality of locations along the circumference of the container. The wires include horizontal sections that are configured to be retained in the base or rim of the container in a manner that permits them to rotate to transition the container between expanded and collapsed positions.

18 Claims, 10 Drawing Sheets

TWIST-FOLD CONTAINERS

PRIORITY CLAIM

This application claims priority of U.S. provisional application Ser. No. 61/753,329 filed Jan. 16, 2013, the contents of which are hereby incorporated by reference.

FIELD OF THE INVENTION

This application relates generally to bowls or other containers and stands for bowls or containers, particularly including such bowls or stands supported or formed by collapsible wires.

BACKGROUND OF THE INVENTION

Containers used for holding items such as bread are often large or oversized so as to accommodate a sufficient quantity for serving several people. These large containers are useful on occasion, but their oversized nature makes them difficult to store while not in use in a kitchen or other place where space is at a premium. Moreover, containers for bread or other large items are often clear or otherwise constructed from material that permits one to view the items from outside the container. Oftentimes, the containers may be situated to hold fruit or vegetables where the fruit or vegetables need rinsing. In such cases, the containers should be substantially permeable so as to let water flow through such as in the case of a wire basket.

Therefore, there is a need for containers of a kind that can accommodate large-sized items and that can be collapsed and stored in a manner that takes up little space. There is also a need for such containers to be constructed from material that can permit viewing from the outside and to further be permeable so that water can pass through them and so that they can be used for rinsing items like fruits and vegetables.

Containers used for parties and other special events often have several components. For example, there may be a bowl for chips and another bowl for dip. Further, the dip bowl may include a plurality of partitions to separate one kind of dip from another kind of dip. Likewise, the chip bowl could be similarly partitioned. Moreover, the separate chip bowl is often designed to match the dip bowl, often including the same elements of aesthetic design, color, or other characteristics.

Due to their separate nature, containers used for parties and special events can often become lost or damaged, leaving sets incomplete and not useable for the intended event or party. Moreover, these items may not be used on a regular basis, but may nevertheless occupy significant storage volume even when not in use. Further, such items are often constructed from fragile materials that can be easily broken, chipped, or otherwise damaged to the point that they become not useable for their intended purpose.

There is therefore a need for party or special event containers to be physically connected in some fashion so as to not become separated, thereby avoiding the common problem of incomplete sets through loss or damage. There is a further need for such containers to be durable and storable in a fashion that takes ups the least amount of space.

SUMMARY OF THE INVENTION

The invention includes a collapsible twist-fold container comprising at least one wire wherein the wire has a first generally horizontal portion and a second generally horizontal portion, wherein said first generally horizontal portion is pivotally connected to a rim of the container, and wherein said second generally horizontal portion is pivotally connected to a base of the container.

The invention also includes a set of collapsible twist-fold containers comprising at least two containers wherein the containers are connected by at least one wire wherein the wire has a first generally horizontal portion and a second generally horizontal portion, wherein said first generally horizontal portion is pivotally connected to a rim of a first container, and wherein said second generally horizontal portion is pivotally connected to a rim of a second container.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1A:
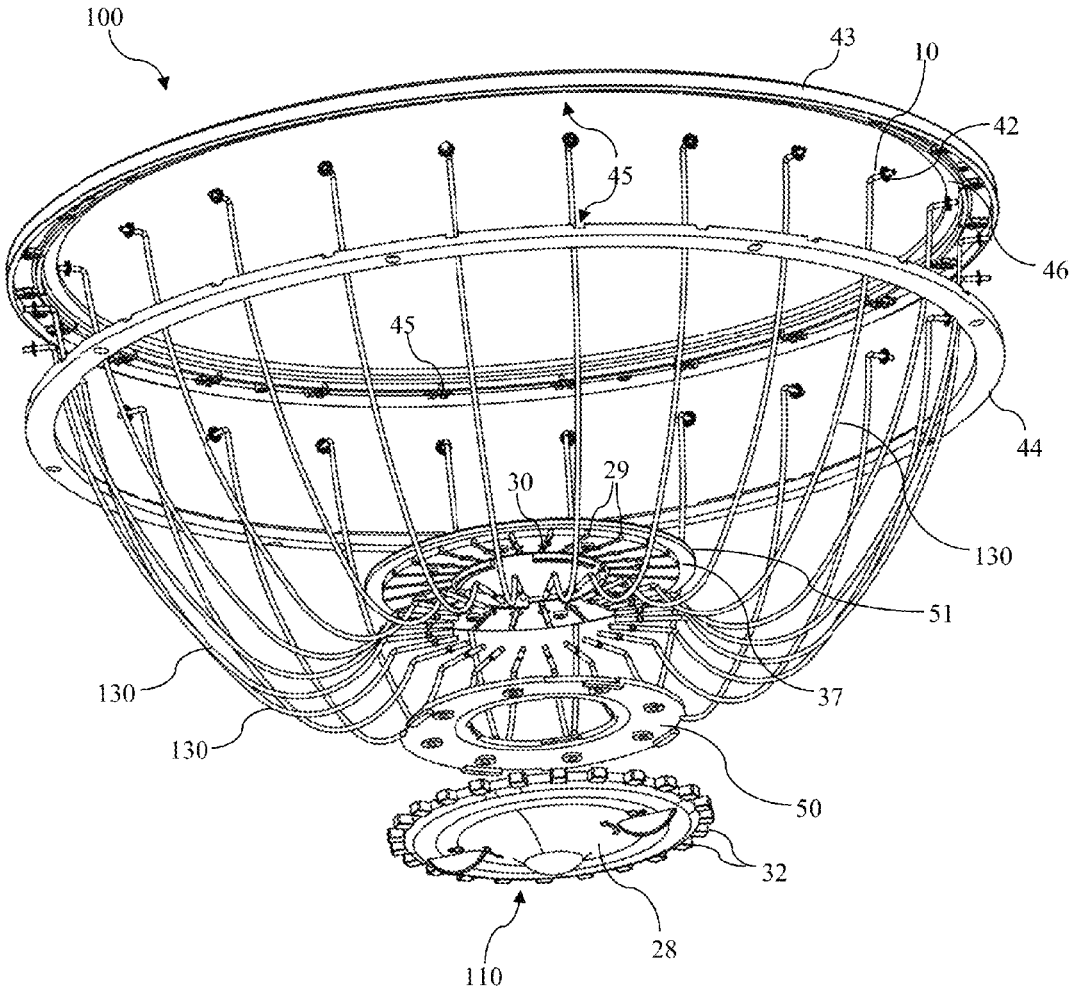
FIG. 1A is an exploded perspective view of a twist-fold bowl made in accordance with principles of the invention.
Figure 1B:
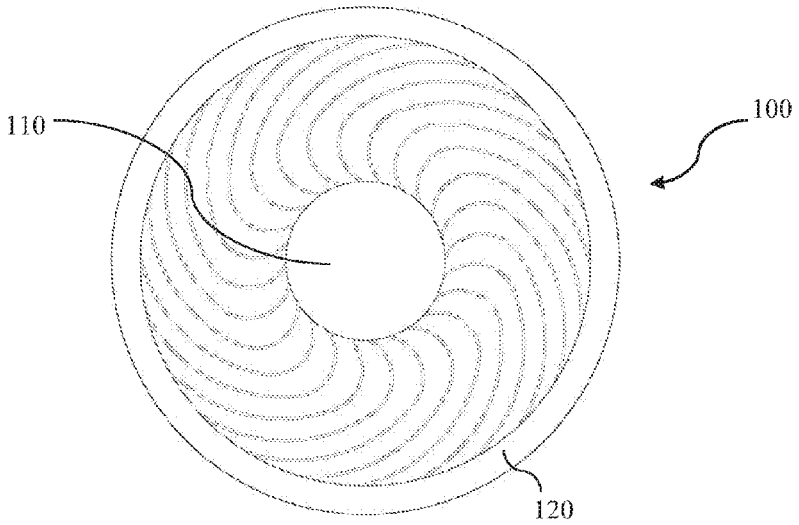
FIG. 1B is a top plan view showing the twist fold bowl of FIG. 1A in a collapsed position.
Figure 1C:
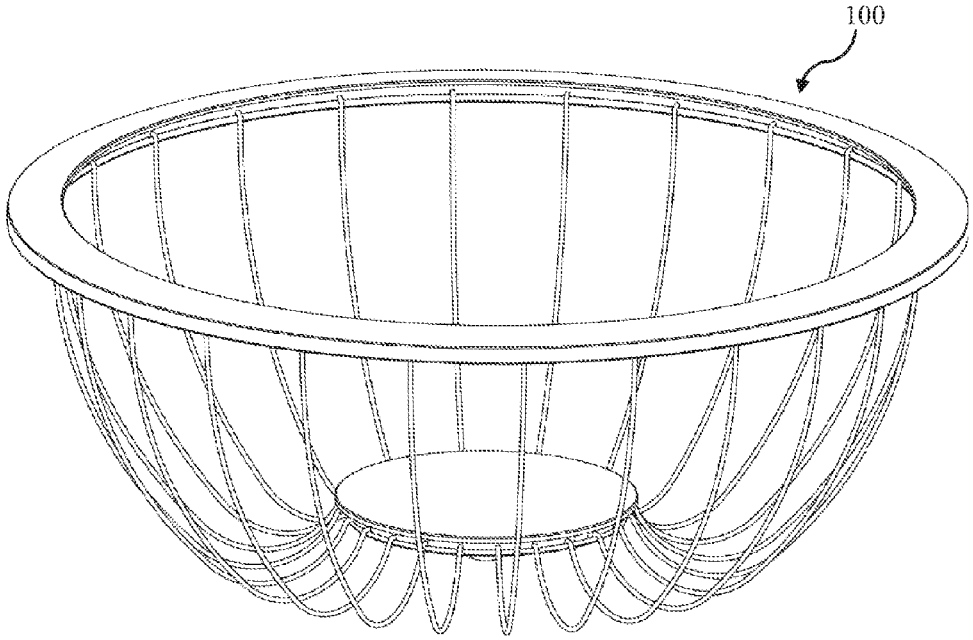
FIG. 1C is a front perspective view of the bowl of FIGS. 1A and 1B, shown in an expanded position.

In accordance with one version of the invention shown in FIGS. 1A-1C, a container 100 such as a bowl is formed having a base 110, a rim 120, and a plurality of wires 130 extending between the base and the rim. The container 100 is useful as a bowl to hold objects of a certain size, i.e., those which will not fall through the spaces between the plurality of wires 130. The container 100 may have other uses than as a bowl. Moreover, the container can be easily collapsed for storage using a twisting motion to occupy a generally collapsed position as shown in FIG. 1B, or an expanded position as shown in FIG. 1C.

Figure 2A:
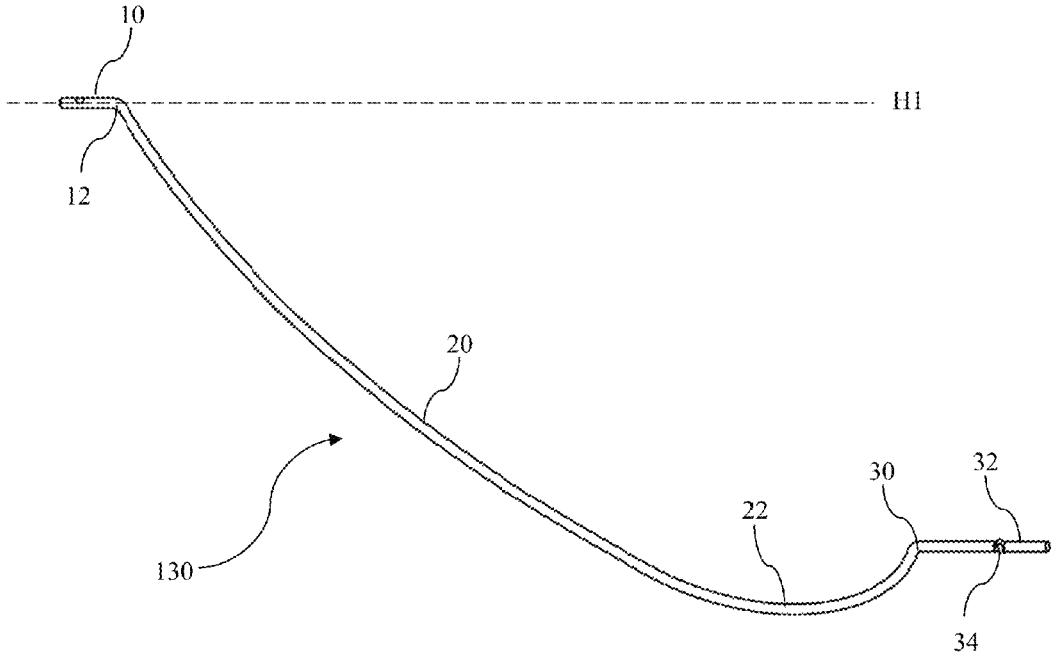
FIG. 2A is a front view of a wire for use in constructing a twist-fold bowl made in accordance with principles of the invention.

As shown in FIG. 2A, a preferred shape for the wires forming a container made in accordance with principles of the invention is described with respect to a horizontal reference plane H, in which the horizontal reference plane H is parallel to, for example, a countertop upon which the container may sit. With respect to this reference plane H, the wires 130 include a first generally horizontal portion 10 which, when assembled into the container, will terminate in a direction extending radially outward from the center of the container. The first generally horizontal portion transitions to an elongated vertical portion 20 in which the transition point 12 is formed as a sharp bend in the wire. In one illustrated version, the bend is preferably somewhat less than 90 degrees relative to the horizontal reference plane H1, and therefore the vertical portion 20 will typically not extend in a direction orthogonal to the horizontal portion 10. Most preferably, in one version the angle is approximately 80 degrees and the wire is curved somewhat as it extends downward and inward toward the center of the container. In other versions the bend is shallower and may be between about 40 degrees and 90 degrees. In general, the nature of the bend contributes to the shape of the bowl when it is assembled.

In one version as shown in FIG. 2A, the vertical portion 20 terminates in a shallow hairpin 22, such that the wire 130 extends downward and then follows a bend in which it curves upward again. After the shallow hairpin at the base of the wire, the wire bends at a second transition point 30 and forms a second substantially horizontal portion 32, with the second substantially horizontal portion extending outward in a direction generally opposite that of the first substantially horizontal portion.

Figure 2B:
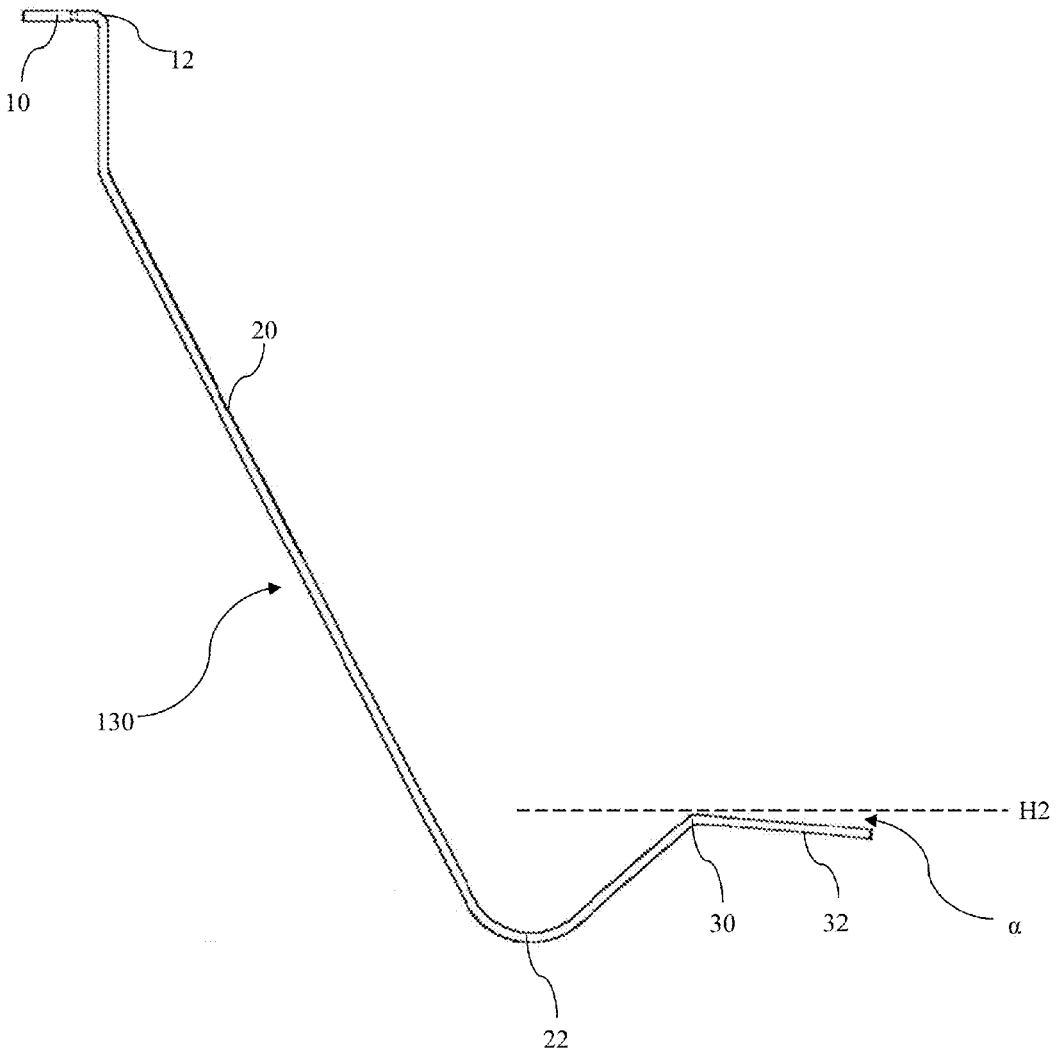
FIG. 2B is a front view of an alternate wire for use in constructing a twist-fold bowl made in accordance with principles of the invention.

In another version as shown in FIG. 2B, the vertical portion 20 angles downward from the transition point 12 at a bend of about 90 degrees, transitioning again to an incline as the vertical portion continues downward from the first horizontal portion 10. The vertical portion 20 terminates in a hairpin 22, which in the case of FIG. 2B is sharper than that illustrated in FIG. 2A, such that the wire 130 extends downward and then follows a bend in which it curves upward again. After the hairpin at the base of the wire, the wire bends at a second transition point 30 and forms a second substantially horizontal portion 32, with the second substantially horizontal portion extending outward in a direction generally opposite that of the first substantially horizontal portion.

Figure 9:
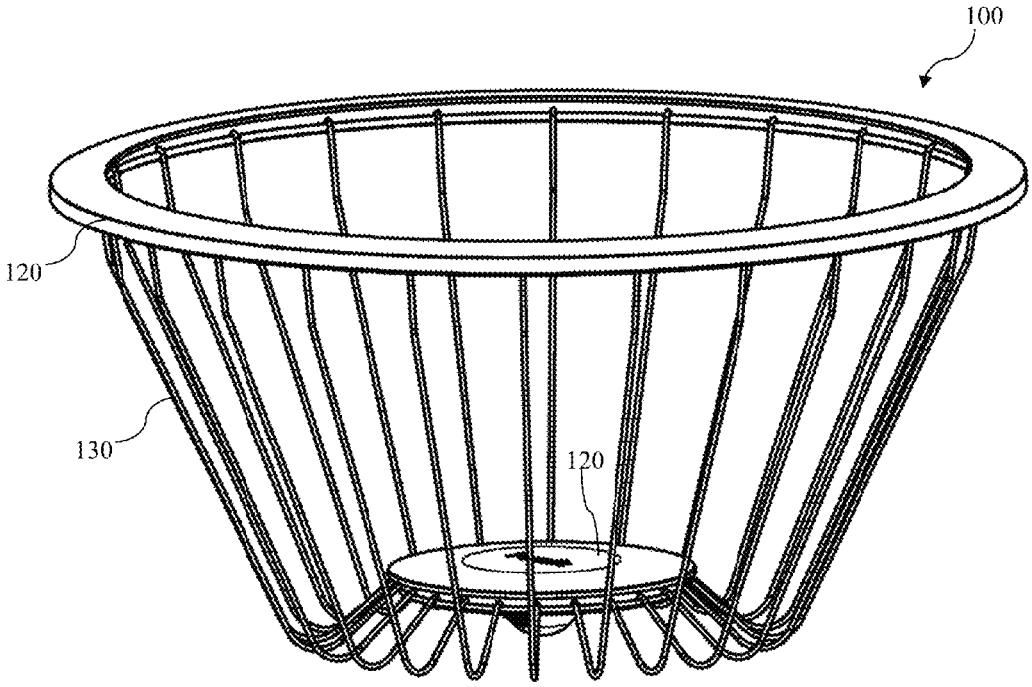
FIG. 9 is a perspective view of a twist fold bowl, configured using wires in accordance with FIG. 2B.

As illustrated in FIG. 2B, the second substantially horizontal portion 32 is formed at a slight downward angle from the horizontal plane H2 (which is intended to be illustrated as being parallel with horizontal plane H1 in FIG. 2A). In a preferred version, the substantially horizontal portion 32 forms an angle $\alpha$ with respect to plane H2 of 10 degrees or less, and preferably 5 degrees. This angular offset with respect to the horizontal imparts a force from the wire against the base when the container is in the collapsed position, helping to bias it in the collapsed position. When the wire is rotated 90 degrees, the angular channel 29 will position the wire end 32 at an angle alpha to the horizontal H2 to bias it towards a slight upward convex shape (as contrasted with a concave shape in the expanded position). This change in angle imparts a force within the channel retaining the wire, and the frictional engagement resists rotation back to the initial position. A perspective view of a twist fold bowl formed using wires in accordance with FIG. 2B is shown in FIG. 9.

Yet another wire shape is illustrated in FIG. 2C, again providing an upper horizontal portion, a vertical portion that angles downward while curving inward from the horizontal portion, and a hairpin curve. The vertical portion and the bottom curve of the wire form the shape of the bowl, and the configuration of the vertical portion may be varied to create a bowl of a desired shape. The wire of FIG. 2C transitions at the second end to a second substantially horizontal portion, again forming an angular offset of preferably about 5 degrees with respect to the horizontal plane H3. The angular offset may be in a direction other than one that is below the horizontal plane, but a downward angular offset is preferred and works better than offsets in other directions.

Figure 3:
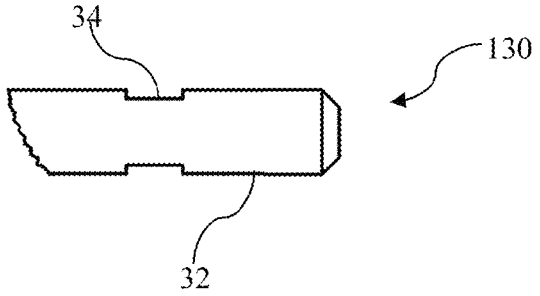
FIG. 3 is a partial cutaway view of a portion of a wire for use in constructing a twist-fold bowl made in accordance with principles of the invention.
Figure 4:
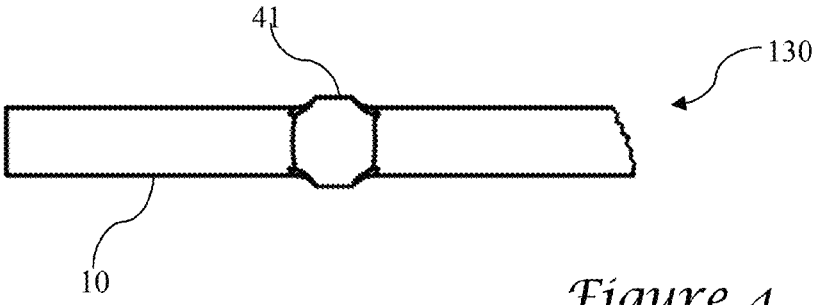
FIG. 4 is a partial cutaway view of a portion of a wire for use in constructing a twist-fold bowl made in accordance with principles of the invention.
Figure 5:
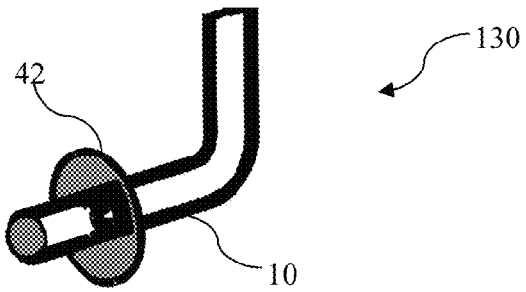
FIG. 5 is a partial cutaway view of a portion of a wire for use in constructing a twist-fold bowl made in accordance with principles of the invention.

As shown in FIGS. 3-5, each of the first and second substantially horizontal portions 10, 32 may have an integrally formed or separately attached retention surface 34, 41 formed at a location close to either terminal end of the wires. The retention surface provides an interface for securing and locating a locking washer 42 at either end of the wires 130 to allow the wires to be trapped within the rim and the base, and to ensure the locking washers are properly located at the desired locations on the wire. In one version, as illustrated in FIG. 3 as being formed on a second horizontal portion 32 of a wire 130, a channel 34 is formed on the wire to provide a location for receiving a locking washer or other such structure for trapping the wire. In another version, as illustrated in FIG. 4, a retention surface 41 extends outward from the wire to form a small flange. In the version of FIG. 4, the retention surface may be formed by crimping the wire to force out of its original cylindrical shape. Though illustrated in FIG. 3 as being on the second horizontal portion and in FIG. 5 as being on the first horizontal portion, either version or yet others may be used on either end of the wire 130.

In a preferred version, the rim forming the container's upper-most circular lip contains retention structures formed in the rim and sized to receive the locking washer 42 as illustrated in FIG. 5, which in cooperation with the wire 130 and the retention surface, keeps the horizontal portion 10 securely attached to the rim. Additional retention structures are formed in the base to retain the opposite end of the wire 130 in the base.

In one version of the invention shown in FIG. 1A, the rim is formed in two sections, including an upper section 43 and a lower section 44. The interior adjoining surfaces of the rim section include a plurality of channels 45 formed for receiving the first horizontal portion 10 of the wire 130 and the attached locking washers 42. The channels are formed with an opening facing the interior of the rim that is sized to snugly receive the wire, but which is smaller than the locking washer such that the locking washer is trapped within the rim and cannot be removed. Although the wire and washer are trapped within the rim, the channels are configured to allow the wires to rotate within the rim. In order to form a container, the container comprises a plurality of wires 130 formed as described above, and the rim includes an equal number of channels 45 configured to receive the wires, with the channels preferably formed at locations equally spaced about the perimeter of the rim.

The rim further includes an inwardly-extending flange 46 adjacent the channels 45. The flange extends around the perimeter of the rim and is positioned inward of the location of the locking washers where the wires are trapped within the rim. As illustrated, the flange 46 is formed in the upper rim portion 43 and extends inward; in various examples of the invention both portions of the rim 43, 44 may have complementary flanges, or it may be formed only in one or the other portion. During a first range of rotational movement of the flange 46 the rim will not impede movement and the wires can freely rotate. Further rotation, however, causes the upper portion of the substantially vertical section 20 of the wire 130 to abut the flange, thereby limiting further rotational movement of the wires. In this fashion, the wires can rotate through a range of movement of about and optionally through 90 degrees. Rotational movement of 90 degrees causes the bowl to transition between collapsed and expanded positions. Further rotational movement would produce, for example, a bowl that transitions between a concave and a convex shape. Ideally the flange is configured to allow for rotational movement of greater than 90 degrees, and preferably about 100 degrees, to allow for a slight convex shape (as contrasted with a concave shape in the expanded position) to further bias the container in the collapsed position against undesired expansion back to the expanded position.

Figure 2C:
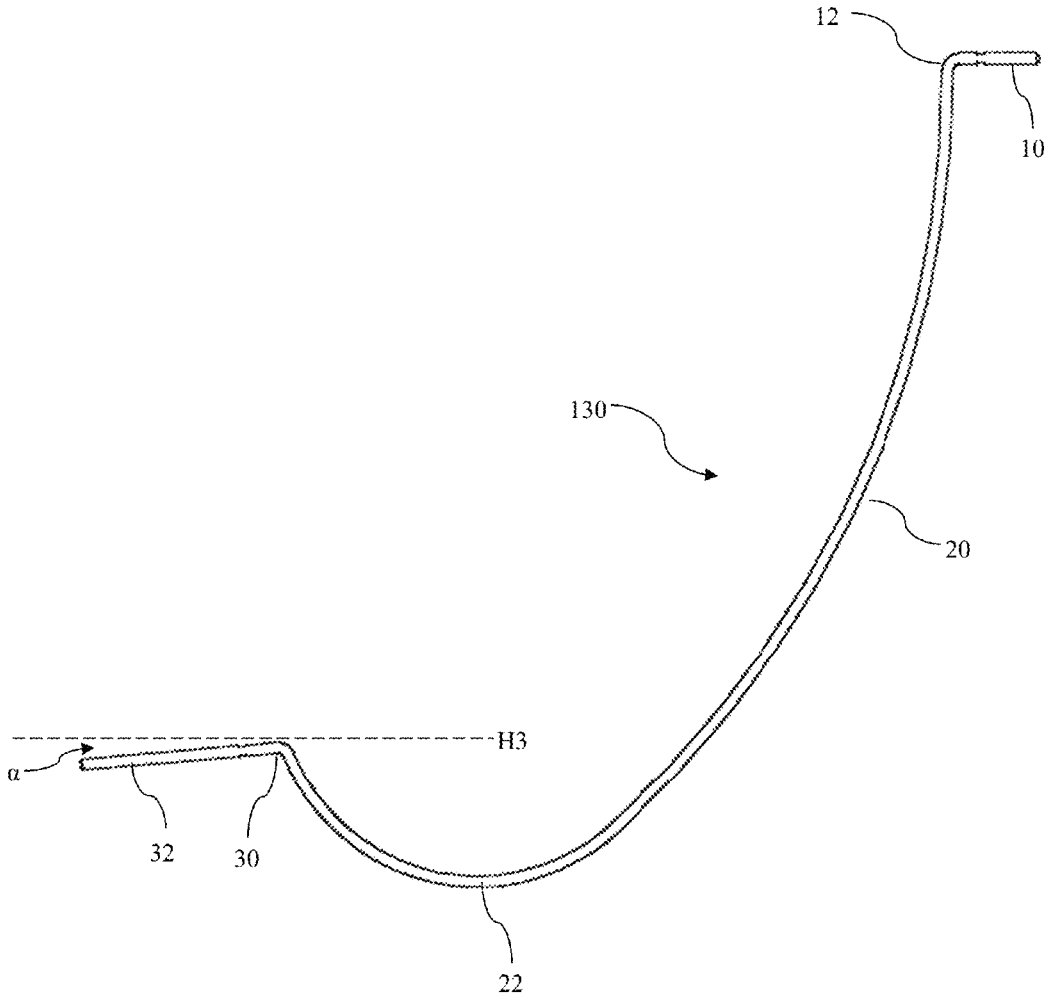
FIG. 2C is a front view of an alternate wire for use in constructing a twist-fold bowl made in accordance with principles of the invention.

The second horizontal 32 portion of the wires positioned at the base of the container, shown best in FIGS. 2A-2C, includes a crimped portion 34 (or other surface, as discussed above) that creates a cross section recessed area in at least one direction, wherein the recessed area may have a width that is greater than the outside diameter of the wire and in a uniform shape.

As shown best in FIG. 1A, the base 110 is formed with a disk-shaped hub 51 in which the hub includes a plurality of channels 29 configured to receive a separate one of the plurality of wires. The channels include a central well 30, sized and shaped to accommodate the crimped portion (or a lock washer or similar surface in other versions) to allow the second horizontal portion 32 to freely rotate within the channels, while at the same time preventing the crimped portion 34 from passing radially through the remainder of the channel (which is sized to accommodate the wire). A retainer ring 50 mounts to the hub 51 (using screws, rivets, adhesive, or other fasteners) to trap the wires 130 within the base.

As with the rim, the hub 51 of the base 110 preferably includes an outwardly-extending flange in some versions of the invention in which the flange allows the wires to rotate through a range of motion of about and optionally through 90 degrees to 100 degrees but thereafter the wires will abut the flange and be restricted against further movement. In the version described above and shown in FIG. 1A, a generally vertical portion of the wire forming the shallow hairpin will abut the flange after movement of about 90 degrees in either direction, thereby preventing inversion of the container. In practice, the inherent flexibility of the wires may allow for a range of motion somewhat greater than 90 degrees in either direction.

In some versions, the hub may optionally include a locking ring 28 formed with a plurality of radially extending teeth 32 spaced apart from one another about the perimeter of the locking ring. The locking ring is attached to the hub 51 or the retainer ring 50 for rotational movement about a central vertical axis extending through the rim and the base. When the container is in the collapsed position, the locking ring may be rotated such that the individual teeth are positioned to trap a portion of the wire (more specifically, a vertical portion of the hairpin section) against the peripheral flange 37 of the hub, thereby preventing further rotational movement of the wires. In order to expand the container, the locking ring may be rotated to position the wires in the spaces between the teeth of the locking ring, thereby allowing rotation of the wires.

As noted above, and further illustrated in the accompanying FIGS. 2A-2C, the wires may be shaped in a variety of ways to thereby create containers having a variety of corresponding shapes. In general, each of the wires includes the first horizontal portion and second horizontal portion, each also having the bends or transition points and hairpin section. The primary difference in the shape of the container is a function of the length and angle of the vertical portion of the wires, as well as the depth and angle of the hairpin section.

Figure 6:
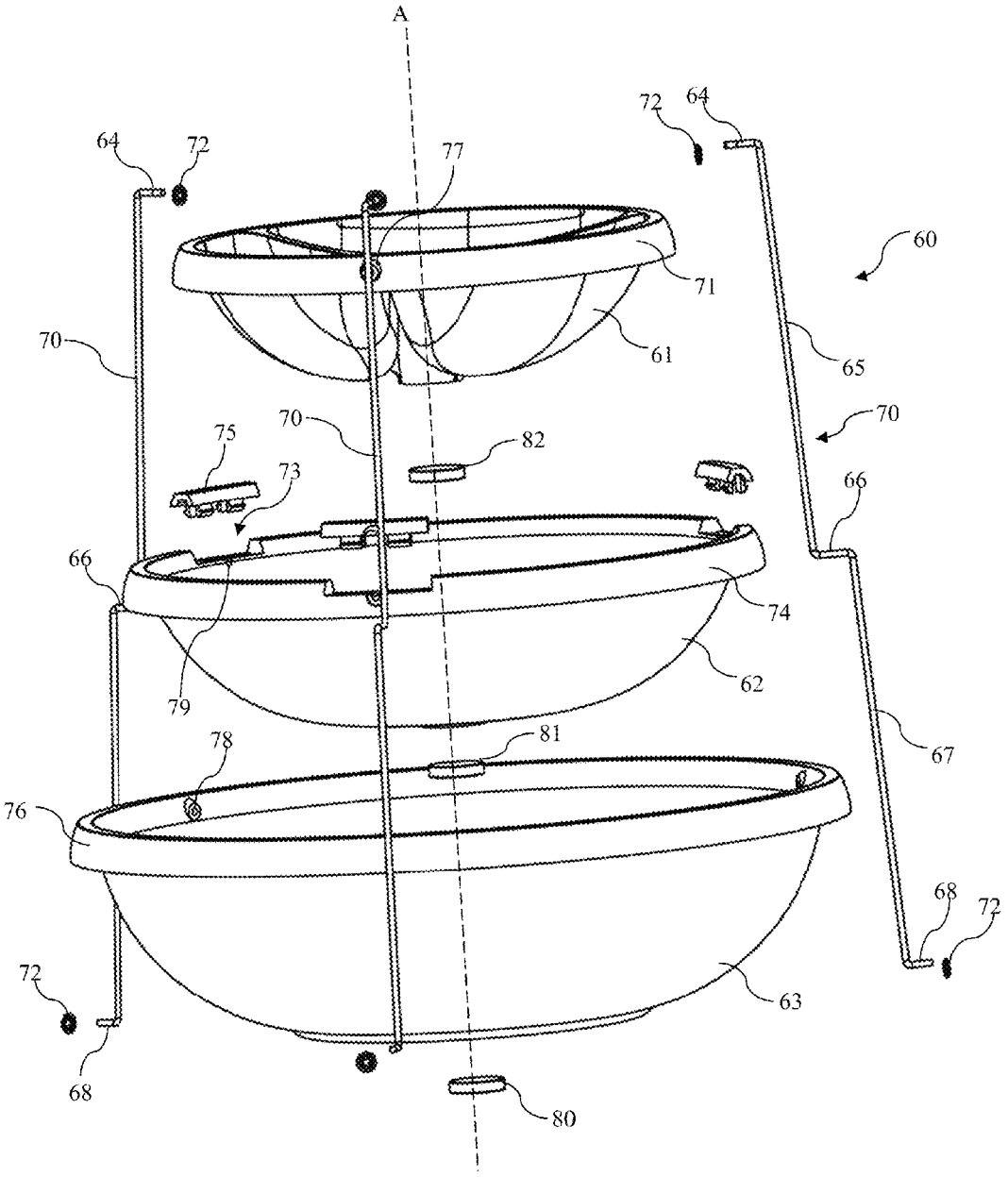
FIG. 6 is an exploded view of a three-tier, twist-fold set of containers, particularly bowls, made in accordance with principles of the invention.

The primary wire configuration aspects as described above for forming a container can be applied to another embodiment of the invention to create a tiered container structure 60 such as shown in FIG. 6. In one arrangement of a set of party bowls, the structure includes a plurality of bowls of varying sizes, including a small bowl 61, a medium bowl 62, and a large bowl 63. Preferably, the large bowl 63 is positioned at the bottom to serve as a base or foundation for the set.

As shown in FIG. 6, the bowls are joined together by a plurality of wires in which the wires are formed with an upper inward-facing horizontal portion 64, an upper vertical section 65, an intermediate horizontal portion 66, a lower vertical section 67, and a lower outward-facing horizontal portion 68. In each case, the vertical sections are preferably angled outward somewhat from top to bottom, rather than being perfectly vertical. The degree of the angled orientation can be a design choice, as a function of the relative sizes of the bowls and the desired separation between them.

The wires are passed through the bowls such that they are pivotally attached to a respective one of the bowls at a corresponding horizontal portion of the wires. Thus, a first wire 70 is pivotally attached to a rim 71 of the upper bowl 61 at the upper inward-facing horizontal portion 64 of the wire 70. The horizontal portion 64 of wire 70 may include a locking washer 72 or may be otherwise trapped within the rim's flange in a manner similar to that of the twist-fold containers as described above. Most preferably, the wire is received within a bore or channel 77 formed in the rim of the upper bowl, with the rim preferably being radially spaced outward and apart from the sidewalls of the bowl.

The intermediate horizontal portion 66 of the wire 70 is pivotally mounted to the middle bowl 62, and in one version as illustrated in FIG. 6, the horizontal portion 66 is trapped between a recessed region 73 in the rim 74, with a bar 75 configured to snap-fit into the recessed region 73. Most preferably, a channel 79 is formed within the recessed region to snugly receive the wire. This configuration traps the intermediate horizontal portion 66 within the rim 74 of the middle bowl 62 while allowing rotational movement of the wire 70.

With continuing reference to FIG. 6, the lower horizontal portion 68 is similarly retained within a bore or channel 78 formed in the rim 76 of the large bowl 63, preferably using a locking washer 72 or other arrangement such as described above. Once secured to the bowls, the wire 70 is able to rotate within the rims of each of the three bowls. In a preferred version of the invention shown in FIG. 6, three such wires are provided, spaced radially equidistant about the perimeter of the bowls. In alternate versions, a different number of wires such as four or more may be used. This configuration allows the wires to support the middle bowl 62 and small bowl 61 in a fashion suspended and spaced apart from the large bowl 63 which also serves as the base. Consequently, each of the bowls may be filled with a food item or other object for ready access.

Because of the pivotal attachment of the wires, the bowls may be collapsed while the wires are attached. By twisting or rotating the small and middle bowls with respect to the large bowl at the base (that is, rotating the upper bowls in either direction of rotation about an axis A extending vertically through the center of each of the bowls), the rotational movement will cause the wires to bend downward, rotating within each of the bores formed in the rims of the bowls, and spiral around the rims of the bowls. In each case, the wire is trapped within a channel formed in the bowl or container, and rotates within the channel when expanding or collapsing the plurality of containers. This action retracts the upper bowl 61 and middle bowl 62 downward to nest within the large bowl 63. In the illustrated embodiment, although the bowls are retractable for nesting, a twisting or rotational force is required in order to nest them. In other words, the bowls will not nest by applying only a downward force in the illustrated embodiment, but rather requires a rotational force. Accordingly, the bowls will retain a stacked configuration in a stable manner unless a user applies a twisting force in order to nest them for storage.

In the case of both the twist-fold bowl and the twist-fold stacking containers, the wires are preferably constructed from a material that maintains a high degree of rigidity while still having a flexible quality. Thus, the wires must be sufficiently rigid to support their own weight and the weight of the additional containers as described, while being flexible enough to bend to expanded and collapsed positions. Preferably the wires are preconfigured to be biased to the expanded positions as illustrated, such that when they are flexed to the collapsed position they have a natural resilient tendency to return to the original expanded position. In various versions of the invention, the wires may be formed from metal, spring steel, glass fiber, carbon fiber, bamboo, or other suitable materials.

Figure 7:
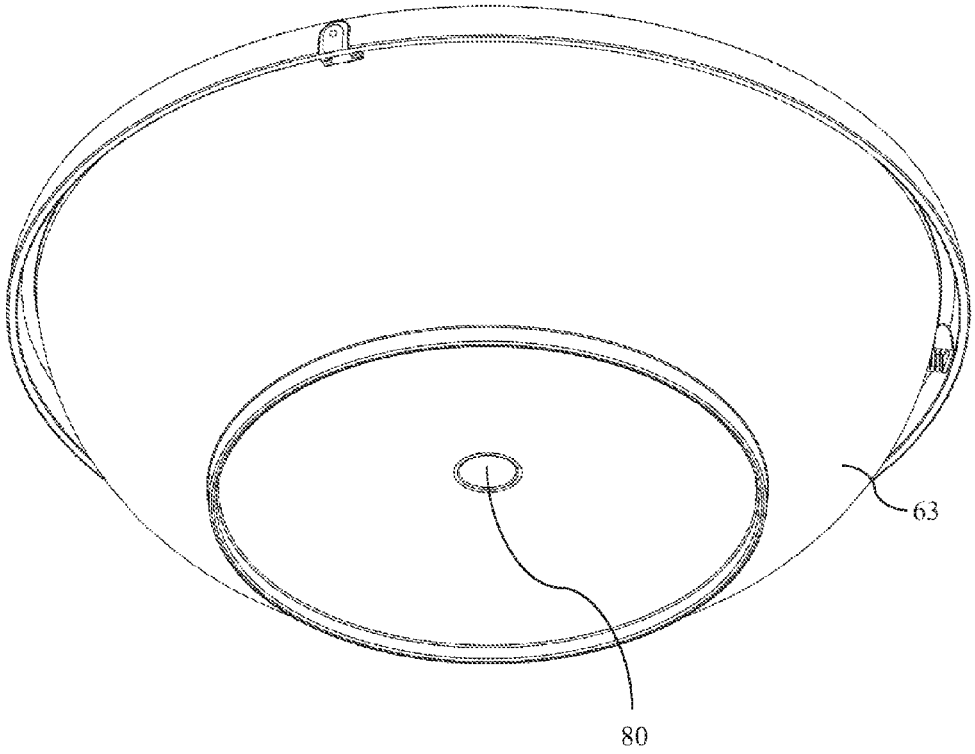
FIG. 7 is bottom perspective view of a bowl in accordance with principles of the invention.

As seen in FIGS. 6 and 7, the lower bowl 63 may include a magnet 80 positioned substantially in the bottom center of the lower bowl 63 and aligned to be in magnetic relationship with another magnet 81 which is positioned in the bottom center of the middle bowl 62. The upper bowl 61 may similarly include a magnet 82 positioned in substantially the same location so as to be in magnetic relationship with magnet 81. When the bowls are collapsed, magnets 80, 81, and 82 are polarly and positionally aligned and cooperate to keep the bowls in a collapsed position even when the set of bowls is shaken or turned over. Through use of magnets 80, 81, and 82, the bowls will stay in a collapsed position until the user manually expands the bowls by rotating them and twisting them back into an expanded position. In another version, the bowls may include complementary engaging surfaces to provide a frictional engagement in the collapsed position.

As shown in FIG. 6, the three-bowl configuration is one version of the invention, but other arrangements are also possible. In another embodiment, three plates, or a mix of plates and bowls, may be used. In either version, the bowls or plates serve as containers that provide a platform for items to be presented. In yet another embodiment, the upper bowl is eliminated and replaced with a handle in which the handle is comprised of three spokes extending outward from a center, each of the spokes terminating in an end configured to receive and retain the upper horizontal portion of the wires. If desired, the base plate or bowl may be configured with a pivotal support base to allow the lower plate or bowl to spin on a horizontal surface, as with a turntable or "lazy susan." Still further, other versions of the invention may include only two or more than three platters or bowls. The plates and bowls may be combined or mixed with one another, for example by including an upper plate with a middle bowl and a larger lower bowl. In some examples, one or more of the bowls may include internal dividers or partitions if desired.

Figure 8:
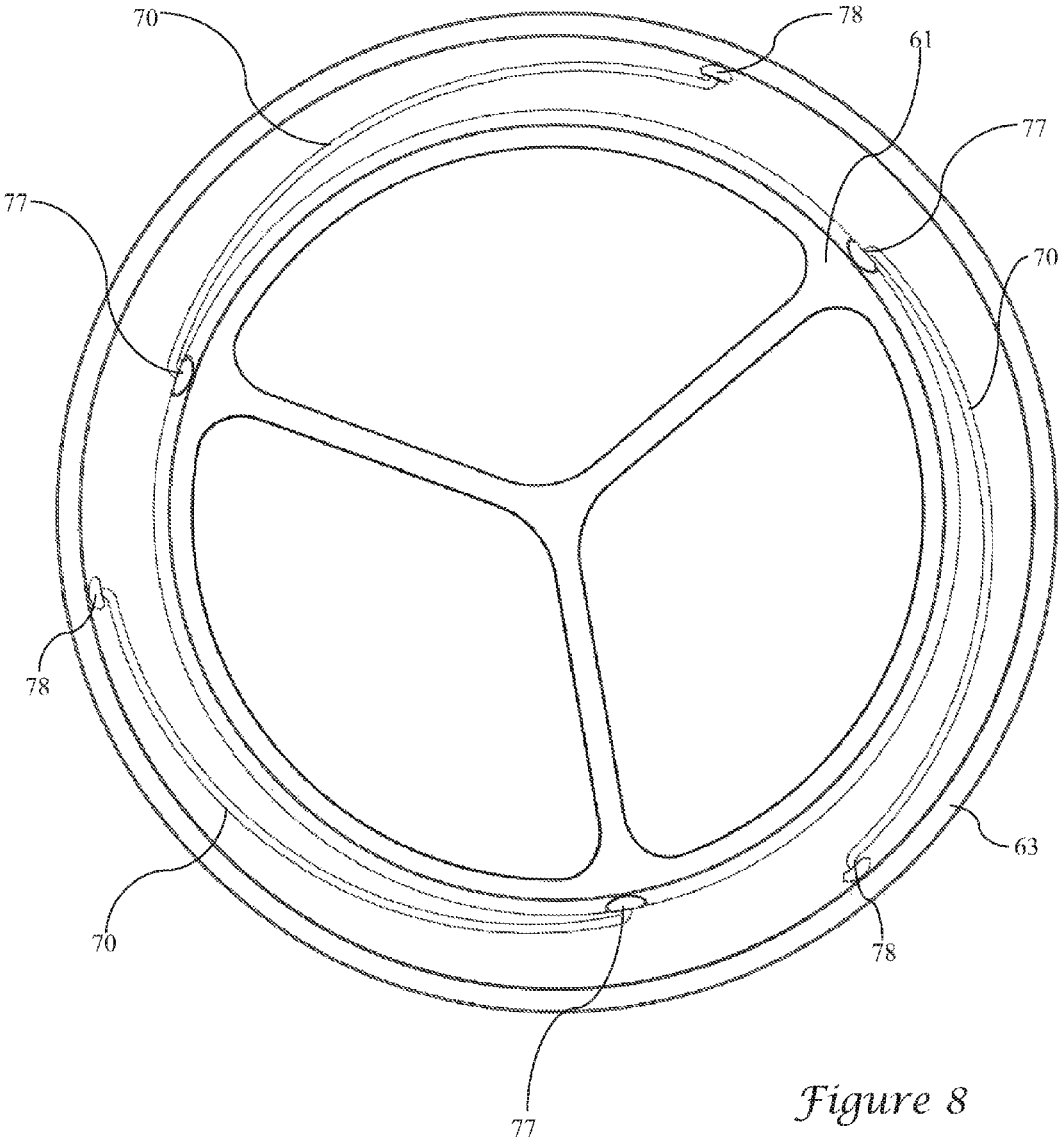
FIG. 8 is a top plan view of a set of two twist-fold containers, shown in a collapsed position.

As shown in FIG. 8, the multiple container set can be collapsed into a nested position. In the particular version as illustrated, three wires 70 are provided in a two-container set. The upper container is in the form of a bowl having three compartments while the lower container is a larger bowl. As noted above, a twist-fold container set may also have one or more additional middle or intermediate containers. Likewise, the containers may be formed as platters or other shapes rather than the particular bowls as illustrated. In addition, the set may be supported by more than three wires if desired. The wires as seen in FIG. 8 have been rotated within the bores 77, 78, and in the collapsed position they are also slightly bent as they extend from the lower bowl bores 78 to the upper bowl bores 77. Preferably, the wires are configured with respect to the locations and distances of the connection points in the bowls such that the amount of flexure is kept to a minimum to avoid imparting a permanent bend in the wires while in the collapsed position. In addition, in the preferred version each of the three (or more) wires is the same length so that the stresses on the wires are the same.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A set of collapsible twist-fold containers comprising:

an upper container;

a lower container; and a plurality of wires attaching the upper container to the lower container, the plurality of wires each having a first generally horizontal portion and a second generally horizontal portion, the first generally horizontal portion being pivotally received within a separate one of a plurality of upper channels carried on a rim of the upper container, and the second generally horizontal portion being pivotally received within a separate one of a plurality of lower channels carried on a rim of the lower container;

wherein the upper container is supported above the lower container by the plurality of wires such that a central axis extends through the center of the upper container and the lower container;

whereby the set of containers is selectively positionable between an expanded position in which the upper container is positioned distant from the lower container and supported by the plurality of wires, and a collapsed position in which the upper container is rotated about the central axis and positioned relatively closer to the lower container and nested within the lower container, each of the plurality of wires being rotatably movable within each of the first plurality of channels and the second plurality of channels to transition the set of containers between the expanded position and the collapsed position, the plurality of wires remaining within the plurality of channels in the expanded position, the collapsed position, and the transition between the expanded position and the collapsed position.

2. The collapsible twist-fold containers of claim 1, wherein each of the first generally horizontal portions includes a first retention member configured to hold the first generally horizontal portion of the plurality of wires within the plurality of upper channels.

3. The collapsible twist-fold containers of claim 2, wherein each of the second generally horizontal portions includes a second retention member configured to hold the second generally horizontal portion of the plurality of wires within the plurality of lower channels.

4. The collapsible twist-fold containers of claim 1, further comprising a middle container, each of the plurality of wires further supporting the middle container between the upper container and the lower container, the plurality of wires each further having a central generally horizontal portion, the central generally horizontal portion being pivotally received within a separate one of a plurality of middle channels carried on a rim of the middle container.

5. The collapsible twist-fold containers of claim 1, wherein said first container is sized to receive said second container in a nesting fashion.

6. The collapsible twist-fold containers of claim 1, further comprising a means for retaining the containers in a collapsed position.

7. The collapsible twist-fold containers of claim 6, wherein the means for retaining the containers in a collapsed position includes at least one magnet secured to a base of at least one of the upper container or the lower container.

8. The collapsible twist-fold containers of claim 1, wherein the in the collapsed position the upper container nests within the lower container, with the rim of the upper container being below the rim of the lower container.

9. The collapsible twist-fold containers of claim 1, wherein the upper container is formed as a bowl.

10. A set of collapsible twist-fold containers comprising:

an upper container;

a lower container, the upper container being smaller than the lower container; and a plurality of wires supporting the upper container above the lower container such that a central axis extends through the center of the upper container and the lower container, the plurality of wires each having a first generally horizontal portion and a second generally horizontal portion, the first generally horizontal portion being pivotally received within a separate one of a plurality of upper channels carried in the upper container, and the second generally horizontal portion being pivotally received within a separate one of a plurality of lower channels carried on the lower container;

the set of containers being selectively positionable between an expanded position in which the upper container is positioned distant from the lower container and supported by the plurality of wires, and a collapsed position in which the upper container is positioned relatively closer to the second container and the plurality of wires are in a spiral configuration between the upper container and the lower container, each of the plurality of wires being rotatably movable within each of the first plurality of channels and the second plurality of channels to transition the set of containers between the expanded position and the collapsed position, the plurality of wires remaining within the plurality of channels in the expanded position, the collapsed position, and the transition between the expanded position and the collapsed position.

11. The collapsible twist-fold containers of claim 10, further comprising a middle container, each of the plurality of wires further supporting the middle container between the upper container and the lower container, the plurality of wires each further having a central generally horizontal portion, the central generally horizontal portion being pivotally received within a separate one of a plurality of middle channels carried on the middle container.

12. The collapsible twist-fold containers of claim 10, further comprising a magnet positioned on at least one of the upper container or the lower container for retaining the containers in a collapsed position.

13. The collapsible twist-fold containers of claim 10, wherein the upper container is formed as a bowl.

14. A set of collapsible twist-fold containers comprising:

an upper container;

a lower container; and a plurality of wires attached to the upper container and the lower container to support the upper container above the lower container, the plurality of wires each having a first generally horizontal portion and a second generally horizontal portion, each of the first generally horizontal portions being pivotally received within a separate one of a plurality of upper channels carried on the upper container, and each of the second generally horizontal portions being pivotally received within a separate one of a plurality of lower channels carried on the lower container, wherein a central axis extends through the center of the upper container and the lower container;

the set of containers being selectively positionable between (1) an expanded position in which the upper container is positioned distant from the lower container and supported by the plurality of wires, and further in which the upper container is in a first rotational position about the central axis with respect to the lower container, and (2) a collapsed position in which the upper container is positioned relatively closer to the lower container and in which the upper container is twisted to a second rotational position about the central axis with respect to the lower container, the plurality of wires forming a spiral configuration when in the collapsed position; and wherein each of the plurality of wires is rotatably movable within each of the first plurality of channels and the second plurality of channels to transition the set of containers between the expanded position and the collapsed position, the plurality of wires remaining within the plurality of channels in the expanded position, the collapsed position, and a transition between the expanded position and the collapsed position.

15. The collapsible twist-fold containers of claim 14, further comprising a middle container, each of the plurality of wires further supporting the middle container between the upper container and the lower container, the plurality of wires each further having a central generally horizontal portion, the central generally horizontal portion being pivotally received within a separate one of a plurality of middle channels carried on the middle container.

16. The collapsible twist-fold containers of claim 14, wherein the first container is sized to receive the second container in a nesting fashion.

17. The collapsible twist-fold containers of claim 16, further comprising at least one magnet secured to a base of at least one of the upper container or the lower container.

18. The collapsible twist-fold containers of claim 14, wherein the upper container is formed as a bowl.

* * * * *